US005868619A

United States Patent [19]

Wood et al.

[11] Patent Number: 5,868,619

[45] Date of Patent: Feb. 9, 1999

[54] METHOD FOR PLAYING A POKER GAME

[76] Inventors: Michael W. Wood, 11831 Wentling Ave. #C, Baton Rouge, La. 70816; Terry L. Wilson, 9121 Round Oak Dr., Baton Rouge, La. 70817

[21] Appl. No.: 948,749

[22] Filed: Oct. 10, 1997

[51] Int. Cl.[6] ..... A63F 1/00

[52] U.S. Cl. ..... 463/13; 273/292

[58] Field of Search ..... 273/272, 224, 273/250–299; 463/12, 13

[56] References Cited

U.S. PATENT DOCUMENTS

| | | | |
|---|---|---|---|
| 5,255,915 | 10/1993 | Miller | 273/292 |
| 5,277,424 | 1/1994 | Wilms | 273/274 |
| 5,294,128 | 3/1994 | Marquez | 273/292 |
| 5,322,295 | 6/1994 | Cabot et al. | 273/292 |
| 5,415,414 | 5/1995 | Savage | 273/306 |
| 5,486,005 | 1/1996 | Neal | 273/292 |

OTHER PUBLICATIONS

"Pai Gow Poker", Linya Quan, WIN magazine, Apr. 1992, pp. 39, 40, 70.

"Double–Handed High–Low", Scarne's Encyclopedia Of Games, John Scarne, Harper & Row Publishers, p. 38, Dec. 1973.

*Primary Examiner*—Benjamin H. Layno
*Attorney, Agent, or Firm*—Quirk & Tratos

[57] ABSTRACT

A method is set forth for playing a game wherein an initial holding of five playing cards is provided for the player, the player assembling the initial holding into one or more sub-hands of one card each. Play is completed by completing each sub-hand to final hands of five cards each. For each completed sub-hand which corresponds to a winning combination, payoffs are provided according to a pay table. For losing sub-hand combinations, the wager is lost. Wagers are allocated on a pro-rata basis to each sub-hand based upon the number of cards in the arranged sub-hands. Payoffs are based upon the allocated amounts of the wager for each sub-hand.

13 Claims, 9 Drawing Sheets

METHOD FOR PLAYING A POKER GAME

FIELD OF THE INVENTION

The present invention relates to table and electronic wagering games such as poker, video poker and slot machines.

BACKGROUND OF THE INVENTION

Table and video poker games are well known. With reference to the electronic video poker games, in a typical game a player makes a selected wager and initiates the play of the game. The processor of the video poker game is programmed to select from a suitable memory structure containing data representing 52 cards of a deck, data representative of a 5 card opening holding. These 5 cards are displayed face up for the player to see. The player can discard some or all of t he cards whereupon the processor from the data structure replaces the discarded cards to define a final holding or hand. If the hand corresponds to a pre-determined schedule or table of poker holdings, e.g. a pair of Jacks or better, four-of-a-kind, flush, the player is awarded a payoff.

There are video poker variations such as deuces wild, where the deuces of the deck of cards are wild, Joker's wild where an additional Joker is included in the deck and which is wild as well as Joker/deuces wild games.

A drawback of these type of games is that large jackpots cannot be offered. Usually the highest jackpot is paid for a royal flush which is, for a machine which accepts 5 coins or tokens as a maximum wager, 4000 tokens or coins based upon the maximum play. The use of progressive machines linked together which assemble a progressive jackpot until a royal flush is obtained, can provide higher payoffs. However, because of the probabilities for obtaining an outcome such as a royal flush, jackpots cannot be offered of tens of thousands or millions times the amounts of the wager. It is well known that offering large jackpots entices players to play the game.

To overcome the inability to offer large prizes in video poker it is known to vary the play thereof for example as described in U.S. Pat. No. 5,531,441 issued Jul. 2, 1996 to Dabrowski. According to this patent, two distinct opening holdings or hands are selected from data representing different decks. The opening holdings are displayed. If one or more of the cards of the opening holdings match each other in suit and/or position an award is provided. Thereafter the player selects which of the opening holdings to play and plays the selected hand according to the technique described above. Because the odds of cards dealt from two distinct decks will be of the same suit and occupy the same position in separate hands are quite low, significant jackpots can be offered for matching hands.

In the aforementioned games, the player's success with the hand is often based upon the opening holding and the player's luck in obtaining suitable replacement cards. Since they can only play one hand at a time, a poor initial holding usually means that the player will lose all of their wager. This can be frustrating to a player who perceives that he/she is continually receiving poor initial holdings and, as a result, losing their wagers. There is therefore a need for a game which offers a player greater opportunities to win at least a portion of their initial wager back and which can offer significant jackpots.

SUMMARY OF THE INVENTION

There is, therefore, set forth according to the device and method of the present invention a game to be played with playing cards wherein a player makes an initial wager. A first hand of 5 cards is dealt to the player who groups the first hand cards into one or more sub-hands of at least one card each. Preferably the player's wager is allocated to each sub-hand based upon the number of cards in the group's sub-hand. Additional cards are dealt to each sub-hand to form, for each sub-hand, a completed hand of 5 cards. Designated payoffs are provided for completed sub-hand combinations.

The device according to the present invention includes means for a player to make a wager. A data processor includes a first data structure including data representative of each card of a deck of cards. The deck may be a standard 52 card deck or an altered deck such as by additionally including a Joker. Means are provided for the player to initiate play of the game, the processor upon initiation adapted to select data representative of 5 cards from the first data structure for a first hand and to display representations of the cards of the first hand at a display. Means are provided for the player to group the cards of the first hand into one or more sub-hands of at least one card each. The processor is preferably adapted to allocate a portion of the wager to each sub-hand based upon the number of cards in the sub-hand. Thereafter, the player completes the hand by suitably prompting the processor which selects from the first data structure cards sufficient to complete each sub-hand to a completed hand of 5 cards each. The processor includes a second data structure including data representative of winning outcome card combinations and means for comparing the card data for each completed sub-hand to data of the second structure to determine whether any completed hand has obtained a winning outcome combination. If a predetermined winning outcome is obtained, means are provided for rewarding the player for each winning outcome.

As a further variation, a number of the above-described gaming devices may be linked to a second processor which, from wagering data, assembles a progressive jackpot. The second processor is provided with data or interrogates the individual gaming devices to determine when a pre-determined progressive jackpot is obtained by a player playing their machine. The pre-determined progressive jackpot may be, for example, two royal flushes, a royal flush and four-of-a-kind or the like.

As can be appreciated, the method and devices according to the present invention provide a game which offers a player a greater opportunity to obtain a winning hand since the player can arrange the initial holding to result in up to five completed hands, some or all of which may represent winning combinations. Furthermore, large jackpots may be offered based upon the remote probabilities of obtaining, for example, two royal flushes.

BRIEF DESCRIPTION OF THE DRAWINGS

These and other features and advantages will become better appreciated with reference to the specification, claims and drawings wherein;

DESCRIPTION

Figure 1:
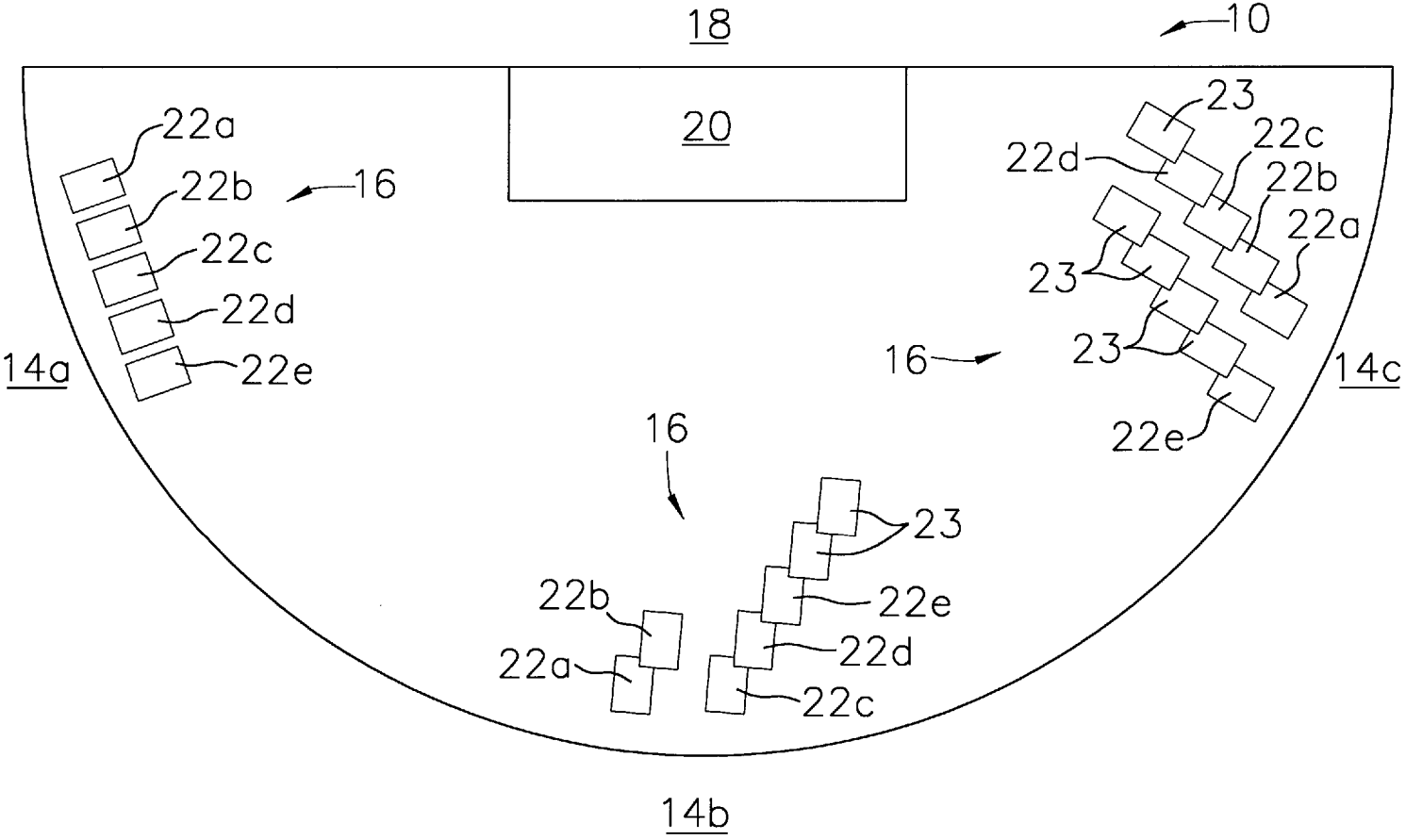
FIG. 1 illustrates a layout for a table game version of the game according to the present invention.

With reference to FIG. 1, the table game version of the method according to the present invention is shown. A table 10 is provided which has described thereon a layout 12 defining a plurality of player positions, shown as positions 14*a–c* having action areas 16 for each of three players. While only three player positions 14*a–c* are shown, it is to be understood that the layout 12 could describe up to six or more such positions to accommodate more players. Depending upon the number of players, multiple decks of cards may have to be used so that the hands according to the method of the present invention can be completed. The layout 12 also describes a dealer position 18 which includes thereat a chip or check tray 20 to hold chips received and distributed during the play of the game.

To play the game, each player makes a wager and is playing to obtain one or more winning outcomes. Table 1 below shows, according to the preferred embodiment of the present invention, a pay table of the winning outcomes which the players are striving to achieve.

TABLE 1

| OUTCOME | PAYOFF |
|---|---|
| Royal Flush | 800 to 1 |
| Straight Flush | 50 to 1 |
| Four-of-a-Kind | 25 to 1 |
| Full House | 8 to 1 |
| Flush | 6 to 1 |
| Straight | 4 to 1 |
| Three-of-a-Kind | 3 to 1 |
| Two Pair | 2 to 1 |
| Pair of Sixes or Better | 1 to 1 |

According to the preferred method, each player must make a wager in increments of five units. For example, where the table 10 is a dollar table, each player must make wagers in increments of $5.00, e.g. $5.00, $10.00, $15.00, etc.

After each player has made their chosen wager, the dealer deals from a deck of playing cards an initial holding 22*a–e* of five cards to each player. Again, if a large number of players are playing the game, multiple decks may be required. Furthermore, if the game is being played with jokers wild, the deck would include the standard deck or decks plus the requisite number of jokers. Accordingly, it needs to be understood that while the description as hereinafter set forth is directed to play of the game using standard deck or decks of 52 cards, that any modified decks can be used. Furthermore, while description is directed to a game based upon the rankings of hands of stud poker, it is to be understood that the game could be played in a deuces wild, joker's wild or deuces and joker's wild format.

After being dealt their initial holding, each player views their cards and opts to group the cards into one or more sub-hands containing at least one card. For example, the player at player position 14*a* has elected to group the initial holding 22*a–e* into five sub-hands of one card each. The player at player position 14*b* has elected to group their initial holding 22*a–e* into sub-hands of two cards and three cards. The player at player position 14*c* has elected to group his initial holding 22*a–e* in sub-hands of one card and four cards.

According to the preferred method of the present invention, the player's wager is allocated to each of the sub-hands on a pro-rata basis. For the player at player position 14*a*, each of the five sub-hands therefore has allocated to it $1.00, for the player at player position 14*b* the sub-hands have allocated to it respectively, $2.00 and $3.00 and for the player at player position 14*c*, the sub-hands have allocated to them, $1.00 and $4.00. Each player by grouping their cards is attempting to obtain for their hand the highest reward.

After the players have grouped their initial holdings into chosen sub-hands, the dealer deals cards to complete each sub-hand to a final hand of five cards each. As illustrated in FIG. 1, the player at player position 14*c* has received the remaining the cards 23 to complete his two sub-hands to a final holding of five cards each. For the sub-hand having four cards of the initial holding 22*a–d*, the dealer has dealt one card to complete that sub-hand. For the hand having the cards in the initial holding 22*e*, the dealer has dealt four cards to complete that sub-hand. In a like manner, the dealer would complete each of the player's sub-hands for the players at the remaining positions 14*a,b* to final hands of five cards each. Accordingly, each player may have a minimum of one final sub-hand, where the player has arranged all of their initial holding 22*a–e* into one sub-hand up to five sub-hands as would be for the player occupying the player position 14*a*.

The outcomes of each of the final hands are thereafter compared to the pay table of winning outcomes. Payoffs for the winning outcomes are based upon the highest ranking outcome obtained and the pro-rata amount of the wager allocated to the sub-hands obtaining winning outcomes. For example, if the player at player position 14*c* obtained a four-of-a-kind in one sub-hand and three-of-a-kind in the other sub-hand, they would be paid $100.00 ($4.00×$25.00) plus $3.00 (3×1) for a total winning payoff of $103.00.

As can be appreciated, the method according to the present invention can produce a combination of outcomes having extremely low probabilities of occurring. For example, the player at player position 14*c* may obtain two royal flushes, the odds against which are extremely high. Because of the remote combinations of holdings which can be obtained according to the method of the present invention, extremely high jackpots can be offered. For example, should the player at player position 14*c* obtain two royal flushes, not only would they receive the amounts dictated by the pay table but they would receive a bonus which could be in the range of several hundreds of thousands if not millions of dollars.

To promote this bonus combination of hands, it may be required that each player to participate in obtaining bonus combinations make an additional bonus wager of, for example, $1.00. Therefore, should the player at position 14*c* make the initial wager of $5.00 and the bonus wager of $1.00 and obtain two royal flushes, that player would obtain not only the payoff as dictated by the pay table but could also win the jackpot for obtaining the double royal flush.

Like jackpots may be offered for other combinations such as a royal flush with four-of-a-kind and the like. Extremely large jackpots may be offered for obtaining triple combinations such as three royal flushes or the like.

Still further, if a separate bonus wager is required for the player to participate in the sub-hand combination jackpot, a portion of each wager may be allocated to assemble progressive jackpot or jackpots to be awarded if the predetermined combination is obtained. Thus, for example, the jackpot for obtaining two royal flushes could progressively grow until a player obtains that jackpot combination outcome.

As can be appreciated, the table game as illustrated in FIG. 1 and described above, offers the players greater opportunity for winning in that they can play up to five hands simultaneously. Furthermore, the player can obtain multiple payoffs depending upon the winning outcomes obtained for each sub-hand. Also additionally, large and/or progressive jackpots can be provided for certain designated jackpot combinations of hands.

With reference to FIGS. 2A–3B, a device 24 according to the present invention is shown for playing the game of the present invention.

The device 24 includes a housing 26 of conventional design. The housing contains a video display terminal or display 28 which displays the various presentations during the play of the game. In a known fashion, a candle 30 is provided for the player to signal that they need change or to indicate that the player has obtained a jackpot. The device 24 includes means for enabling the player to make a wager. These means, where the game is played for purely enjoyment, may simply be means for the player to wager fictitious credits. Alternatively, as shown in the drawings, where the device 24 is used in a gaming establishment such as a casino, the device 24 may include a coin slot 32 by which the player can wager coins such as quarters or dollar tokens. While not illustrated, it is well known to provide a cash reader to accept cash denomination wagers, the cash reader enabling the player to accumulate credits for wagering with the device 24. Additionally, means may be provided for the player to wager from funds on a debit card or the like.

Contained within the housing 26 is a processor (not shown) of conventional design. The processor, in the manner described below, controls the display 28 and play of the game according to the present invention.

Figure 2A:
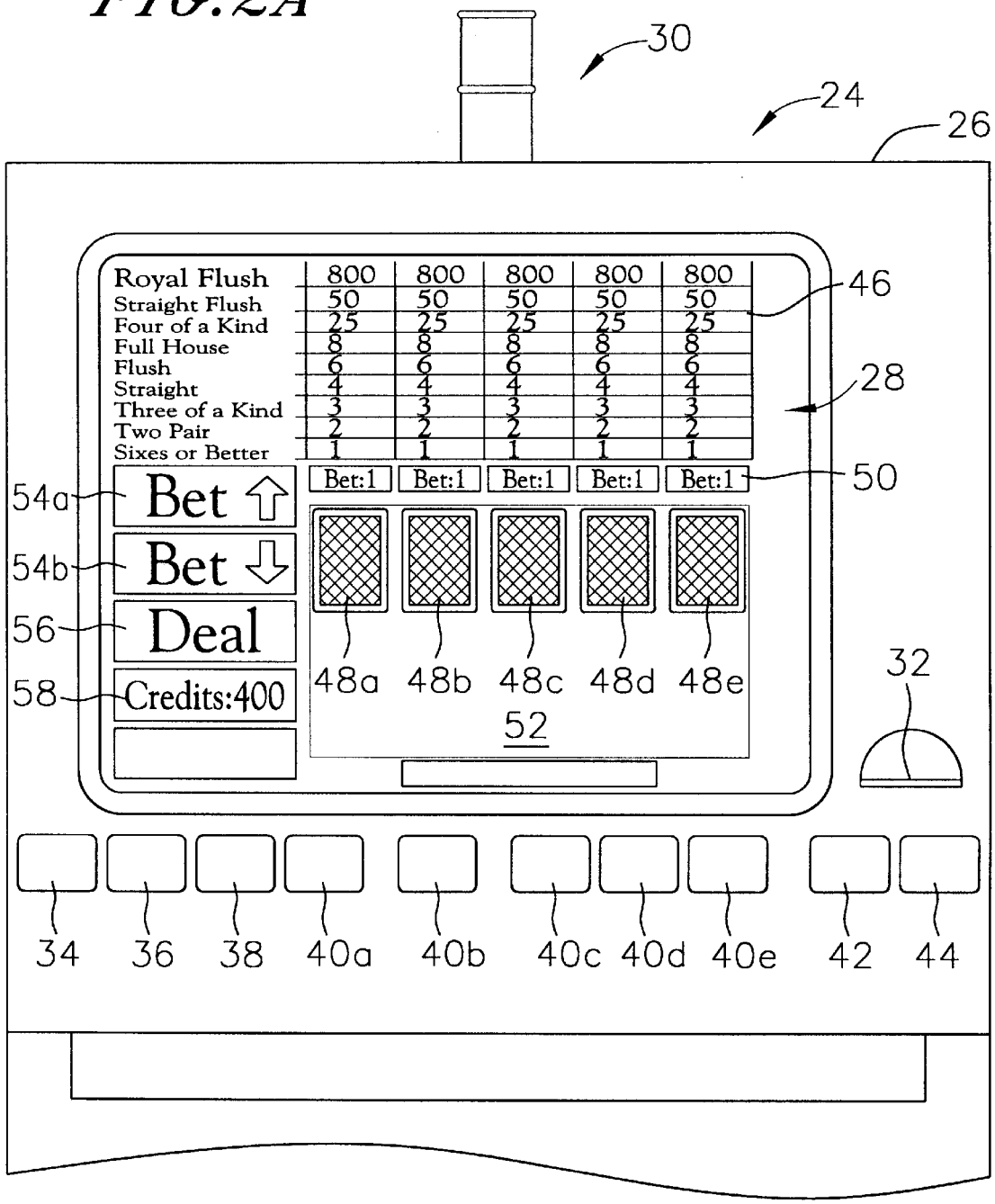
FIGS. 2A–2D illustrate a device for playing a hand of the game according to the present invention.

With continuing reference to FIG. 2A, means are provided for the player to control the play of the game and make various selections as hereinafter described. These means may be embodied as providing a touch screen display 28 or by providing a plurality of push buttons. While the operations of the push buttons will now be described, the remainder of the description will be directed to a device 24 which incorporates a touch screen display of known design.

The device 24 includes a cash out button 34 to enable the player to prompt the processor to distribute to the player in a known fashion accumulated credits in the form of coins or tokens. A bet one credit button 36 is provided to enable the player to wager credits from a minimum wager up to the maximum available for wagering at the device 24. An auto set button 38 prompts the processor to automatically set the hands during the play of the game as hereinafter described in a fashion advantageous to the player. In this fashion, the player need not know how to arrange the sub-hands but can simply use the auto set button 38 for that purpose. Selection buttons 40*a–e* provide for the player to make the selection of cards to be assembled into selected sub-hands. Each of the selection buttons 40*a–e* is associated with a card displayed at the display 28 in the manner as hereinafter described. A max wager button 42 enables the player by depressing the button to make a maximum wager to play the game and simultaneously initiate play of the game. This is conventional with present day video poker machines. Finally, the deal draw button 44 enables the player to prompt the processor to initiate play where a maximum wager is not made and to complete the play of the game by completing selected sub-hands.

The processor includes a first data structure including data representing each card of a deck of 52 cards. Again, if the game is played in a Joker's wild format, the data of the first data structure would represent data of a deck of 52 playing cards plus a Joker. The processor also includes a second data structure which includes data representing winning outcome combinations of the type described in Table 1 above along with the corresponding payouts. Additionally, the processor is programmed to generate the presentations at the display 28 as hereinafter described.

Furthermore, the processor includes means for determining the amount wagered by the player. This amount may be by the player wagering credits accumulated during play of the device 24 or by inserting tokens into the coin slot 32 as described above. Therefore, the processor not only receives data corresponding to the amount wagered by the player but also, as hereinafter described, contains data representing the outcome(s) obtained by the player during play of the game. As described below, this data may be useful where devices 24 are interlinked to accumulate and provide progressive jackpots.

With continuing reference to FIG. 2A, initially the processor is programmed to produce a display as suggested. The display includes a displayed pay table 46 initially presented in five columns each associated with the display of a back of a playing card 48*a–e*. Between the pay table 46 and playing cards 48*a–e* is an allocate window 50 which, as described below, tallies the amount of the initial wager allocated to each sub-hand to be assembled by the player. Where the device 24 is adapted to receive twenty-five cent wagers to a max of five units, i.e. one dollar and twenty-five cents, it is seen that because five playing cards 48*a–e* are shown, each card has associated therewith one unit or twenty-five cents. While the description as hereinafter set forth is directed to the device 25 being a twenty-five cent machine adapted to receive wagers in increments of five units, i.e. one dollar and twenty-five cents, it is to be understood that the device 24 could be adapted to receive wagers in increments of five such as $2.50, $3.75 or $5.00 or the like. Further, it is to be understood that the device 24 could be a $1.00 machine adapted to receive wagers in $5.00 increments in a like manner. The playing cards 48*a–e* are displayed in an action window 52 of the display 28.

With reference to the touch screen display implementation of the present invention, also displayed at the display 28 are increase and decrease bet windows 54*a,b* by which the player may increase or decrease their wager. By touching the screen over the increase bet window 24*a*, the player can wager a greater incremental wager. By touching the screen over the decrease bet window 54*b*, the player can reduce the wager to the minimum increment, i.e. five units. Below the increase and decrease bet windows 54*a,b* is a deal window 56 by which the player may initiate play when less than the maximum amount available for wagering is made. The function of this location is similar to that of a deal draw button 44.

Below the deal window 56 is a credit window 58 which displays the amount of credits available for the player to wager. As payouts are made, credits are added to the tally shown in the credit window 58, in a known manner.

The play of the game will now be described with reference to the device 24 which is a 25¢ device adapted to receive wagers in increments of five units, i.e. a $1.25. This description will assume that the maximum wager is made every play which is five units or $1.25.

Figure 2B:
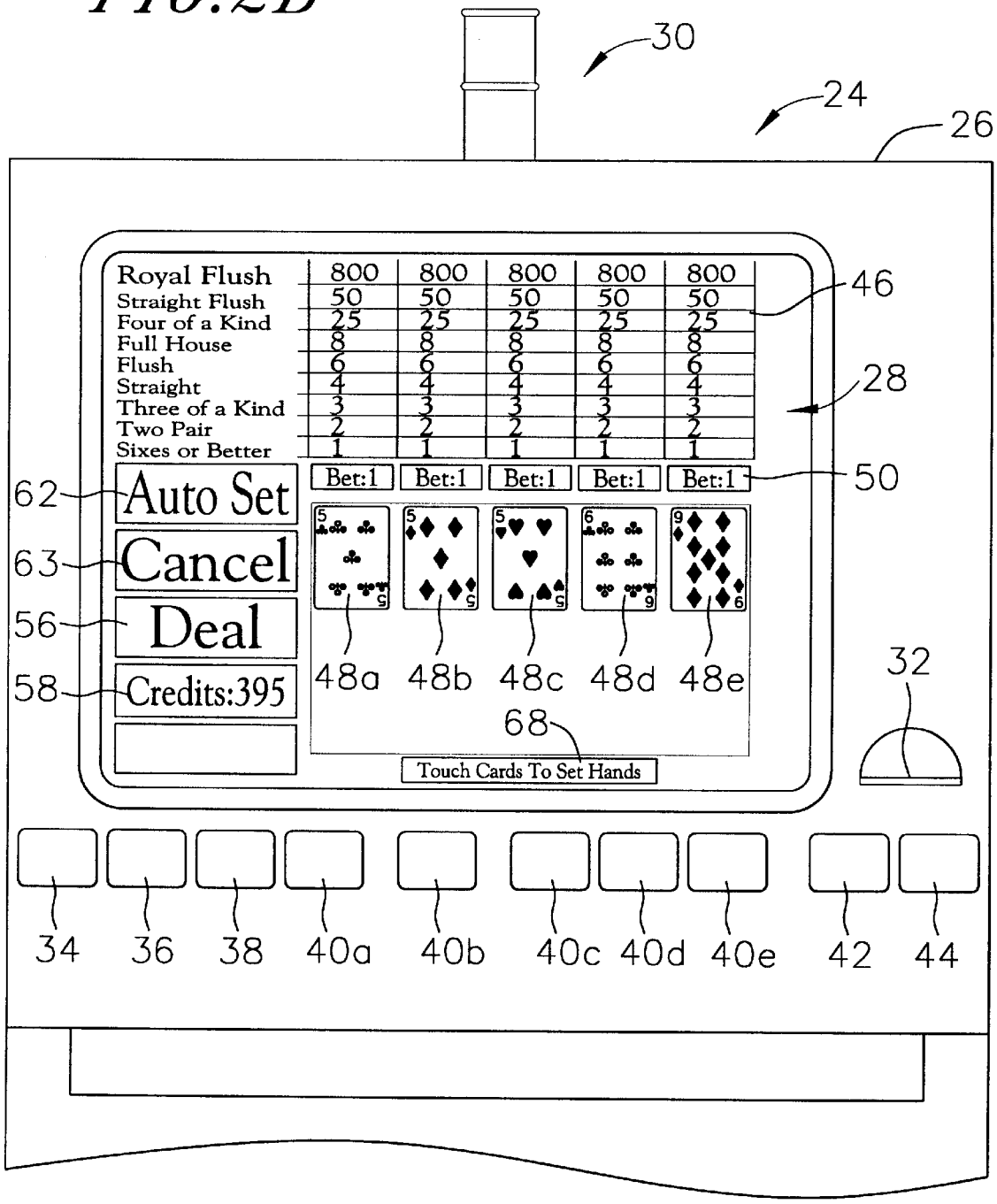
Figure 2C:
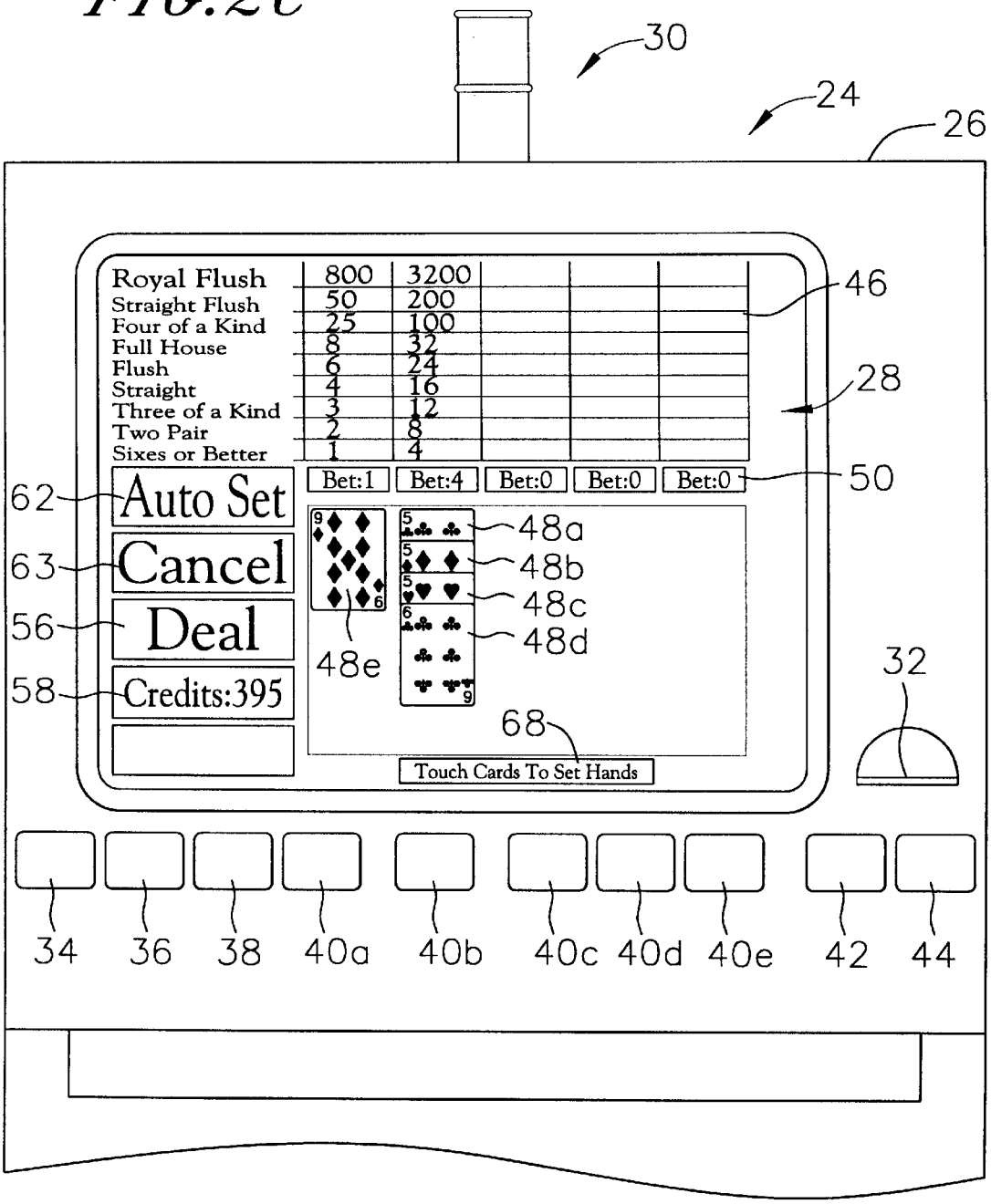

To play the game, the player makes the wager and touches the deal window 56 which prompts the processor to select from the first data structure data representing five cards and to display that data as representations of the faces of the cards 48*a–e*. As shown in FIG. 2B, the player has drawn an initial holding of playing cards 48*a–e* of the five of clubs, five of diamonds, five of hearts, six of clubs and nine of diamonds, respectively. An instruction window 68 may be provided to convey information to the player as to how to complete the play of the hand. At this point the player may manually arrange the initial holding of playing cards 48*a–e* into one or more sub-hands of one card each. This the player does by touching the selected playing cards 48*a–e* and moving the cards to assemble the sub-hands. With reference to FIG. 2C, it is seen that the player has arranged the playing card 48*e* (nine of diamonds) into one sub-hand and the playing cards 48*a–d* into a second sub-hand. With continuing reference to FIG. 2C, it can be seen that the processor based upon the arrangement of the sub-hands, has allocated the wagers accordingly. Accordingly, the sub-hand including the four playing cards 48*a–d* has allocated to it four wagering units whereas the sub-hand containing one card, the nine of diamonds, playing card 48*e*, has allocated to it only one wagering unit. As can also be appreciated, the display pay table 46 also displays the payoffs for winning combinations based upon the number of units wagered. As can also be seen from the display depicted in FIG. 2C, the credit window 58 shows that five credits have been wagered and the initial amount of 400 credits has been appropriately debited.

In the alternative, the player may depress the auto set window 62 which automatically arranges the sub-hands into a determined advantageous arrangement for the player. Accordingly, the processor is pre-programmed to, based upon the playing cards 48*a–e* of the initial holding, to determine the probabilities of obtaining winning payoff combinations and also takes into account the allocation of wagers. With reference to FIG. 2B and 2C, the auto set feature by the player depressing auto set window 62 would arrange the sub-hands as shown in FIG. 2C to maximize the amount wagered in a hand which is likely to receive a higher payoff winning combination. If the player wishes to undo the arrangement of the sub-hands, he/she may touch the screen at cancel 63 which prompts the processor to return the display to the initial holding of FIG. 2B.

Figure 2D:
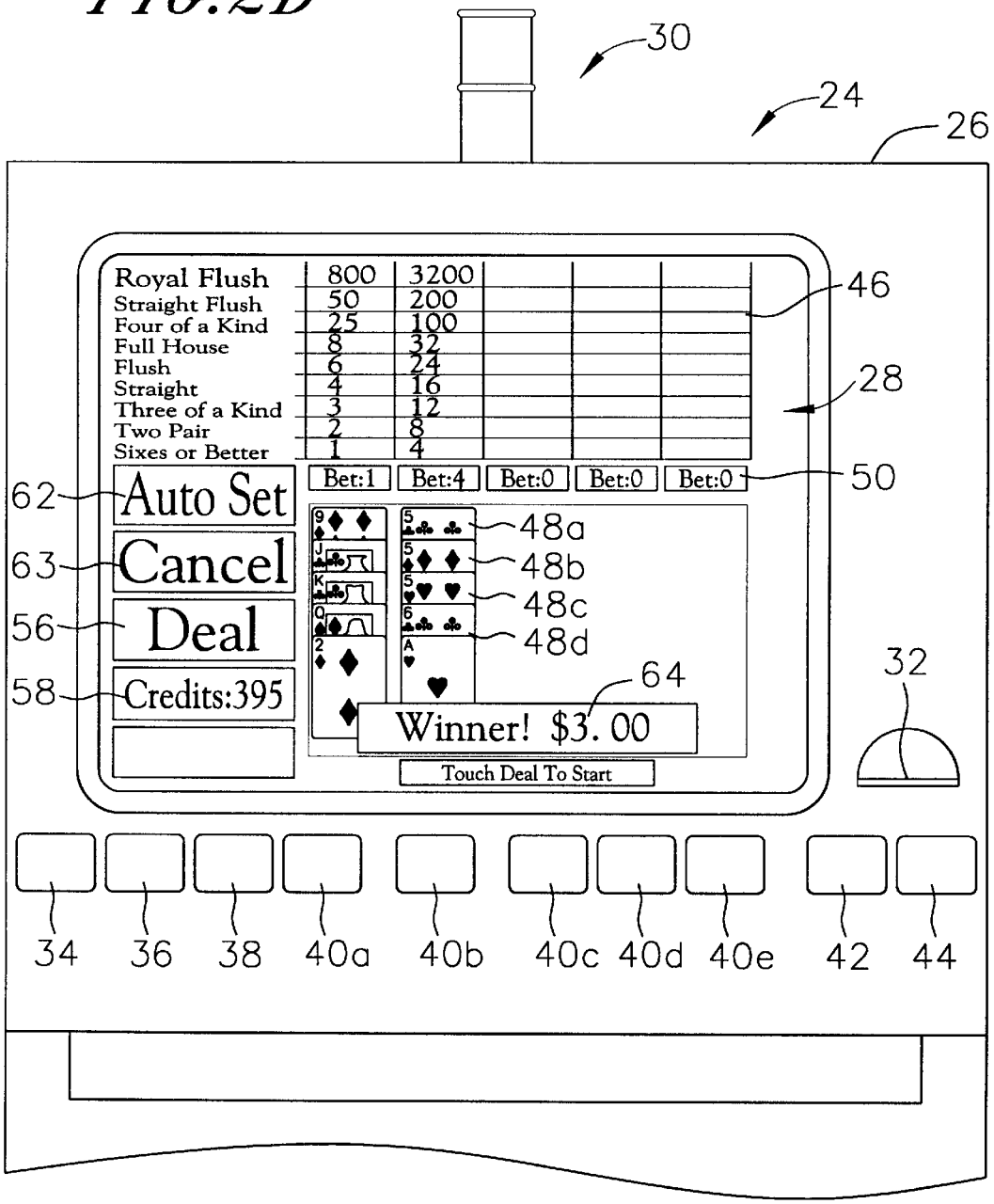

Whether the player uses the auto set feature or manually arranges the playing cards 48*a–e* of the initial holding, after the sub-hands have been arranged, the player touches the touch screen over the deal window 56 to complete the play of the hand. As shown in FIG. 2D, the hands have now been completed. To complete the hand, the processor selects from the remaining card data of the first data structure card data sufficient to complete each sub-hand to a final holding of five cards each. Thus, for the first sub-hand, the processor has selected four cards from the first data structure and for the second sub-hand, the processor has selected one card. These final sub-hand combinations represent the final outcome for the hand.

When the final outcomes are obtained, the processor compares the data of the cards representing the final sub-hands to the data contained in the second data structure to determine if winning outcomes have been obtained. As illustrated, the first sub-hand containing the initial playing card 48*e* of the nine of diamonds, did not result in any winning outcome and accordingly the player lost their one unit wager allocated for this sub-hand. However, for the second sub-hand, the player has obtained a winning outcome of three-of-a-kind for which the player is paid twelve units or, where in this illustration each unit is 25¢, $3.00. The processor may be prompted to display at the display 28 a banner 64 indicating the amount that has been won by the player. The processor accumulates the winning number of credits to the total credits displayed in the credit window 58. Thereafter the player is ready to play another game.

Figure 3A:
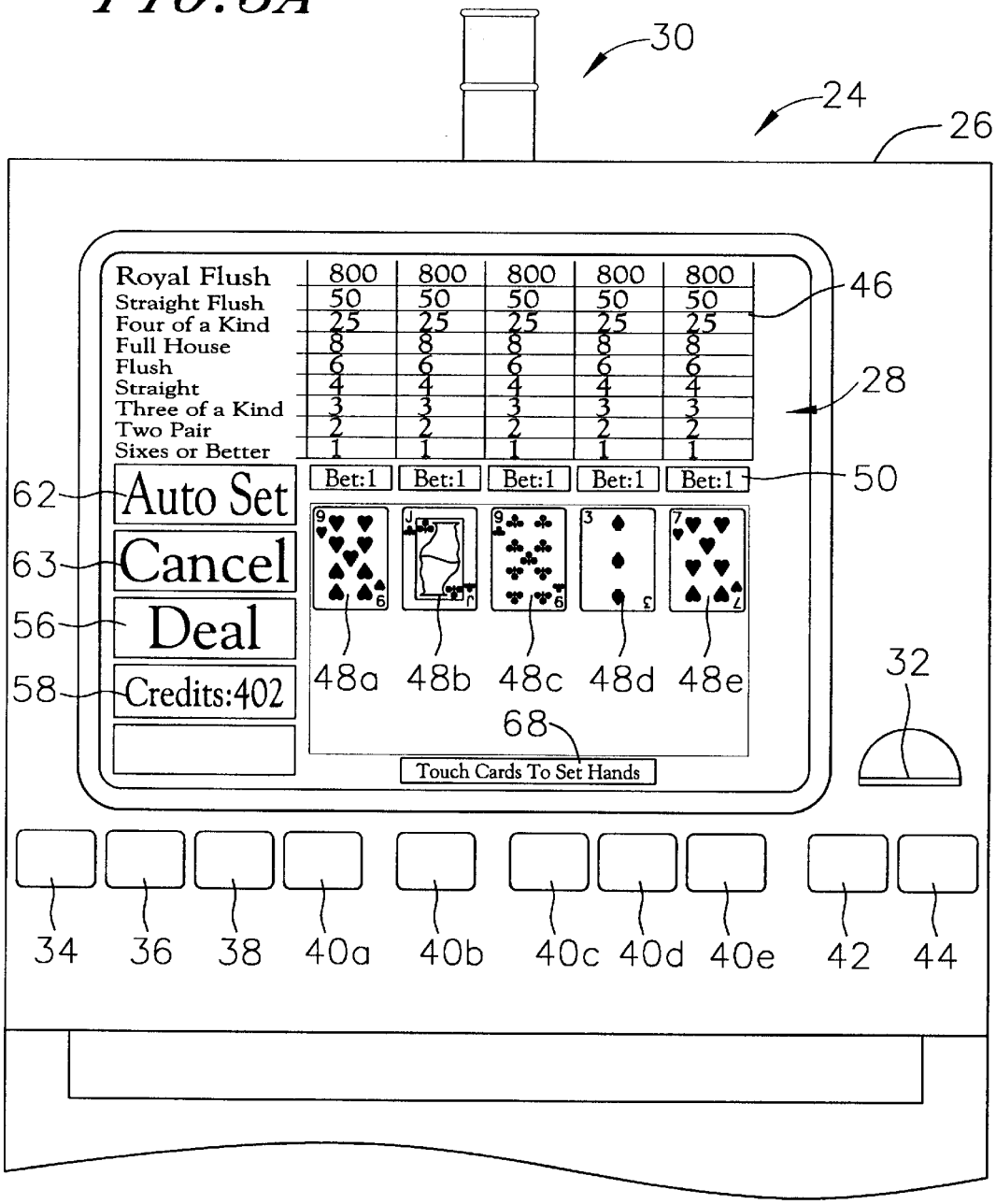
FIGS. 3A–3B show the device of FIGS. 2A–2D showing the play of another hand according to the game of the present invention.
Figure 3B:
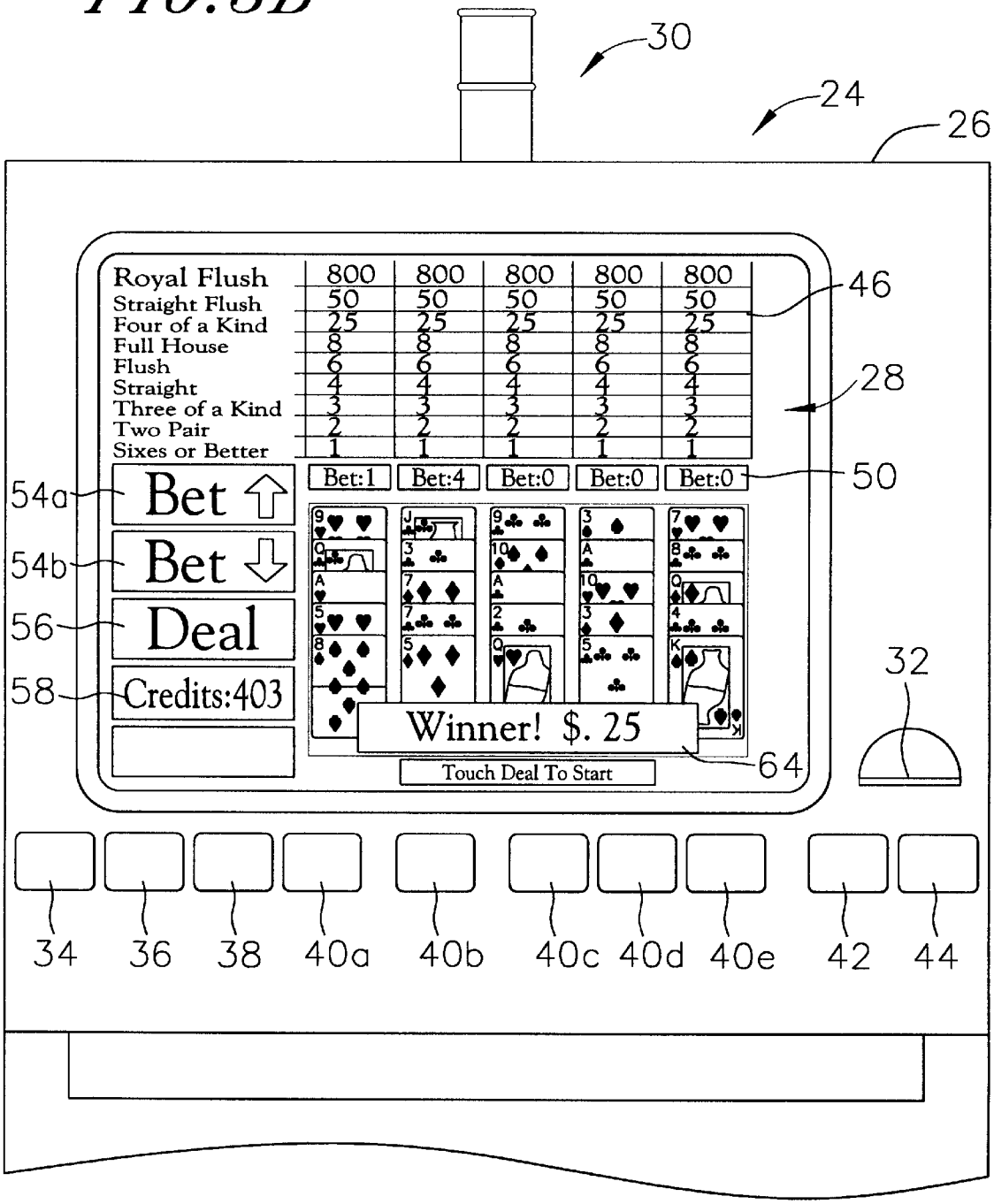

With reference to FIGS. 3A and 3B, the play of yet another hand will now be described.

After the player has made their wager and initiated play, the initial holding of playing cards 48*a–e* is shown. According to this embodiment the initial holding of playing cards 48*a–e* is, respectively, the nine of hearts, Jack of clubs, nine of clubs, three of spades and seven of hearts. Also as shown at the display 28 in each allocate window 50, each of the playing cards 48*a–e* has allocated to it at this point one wagering unit or twenty-five cents. The player then arranges the cards using the touch screen display 28 into one or more sub-hands of one card each. Alternatively, the player may avail themselves of the auto set feature by depressing the auto set window 62 of the touch screen.

As illustrated, the initial holding of playing cards 48*a–e* has not presented any likely winning combination from those initial cards. Accordingly, five sub-hands each containing one card are formed. The player thereafter touches the deal window 56 which completes the play by completing each of the sub-hands to final holdings of five cards each. The processor selects from the first data structure the cards sufficient to complete each sub-hand. As illustrated, the completed sub-hands shown in FIG. 3B show that only the second sub-hand has obtained a winning combination of a pair of sevens. Accordingly, the player has been paid 25¢. The credit window 58 illustrates the debiting and crediting of credits during play. Also as illustrated in FIGS. 3A and 3B, in comparison to FIG. 2D, the display of the pay table 46 is consistent with the allocation of the wagers as indicated by the allocate window 50.

As can be appreciated, the device 24 according to the present invention for playing the game provides the player with multiple opportunities to obtain winning outcomes. As illustrated in FIGS. 3A and 3B, the player can have up to five opportunities to obtain a winning outcome.

Furthermore, it can be appreciated that remote combinations of outcomes can also be obtained. For example, a player may be fortunate enough to obtain two or up to four royal flushes. The happening of obtaining two or more royal flushes is extremely rare and because the probabilities against obtaining such combinations are high, large jackpots may be offered.

Furthermore, it can be appreciated that devices 24 may be linked to each other and coupled to a progressive jackpot processor which allocates a portion from each wagering increment to assemble a progressive jackpot. As players play the devices 24, the progressive jackpot continues to grow. Progressive jackpot outcomes for which the player is paid the progressive jackpot may be selected based upon the combination of outcomes. For example, the progressive jackpot could be offered for a player who obtains two royal flushes or a royal flush and four-of-a-kind or any like combination. Multiple progressive jackpots may be assembled for differing combinations. Still further, a super jackpot could be offered for a player obtaining three or four royal flushes or other remote combinations of final sub-hands. This feature enables the devices to offer extremely large jackpots to entice the players to play.

Figure 4A:
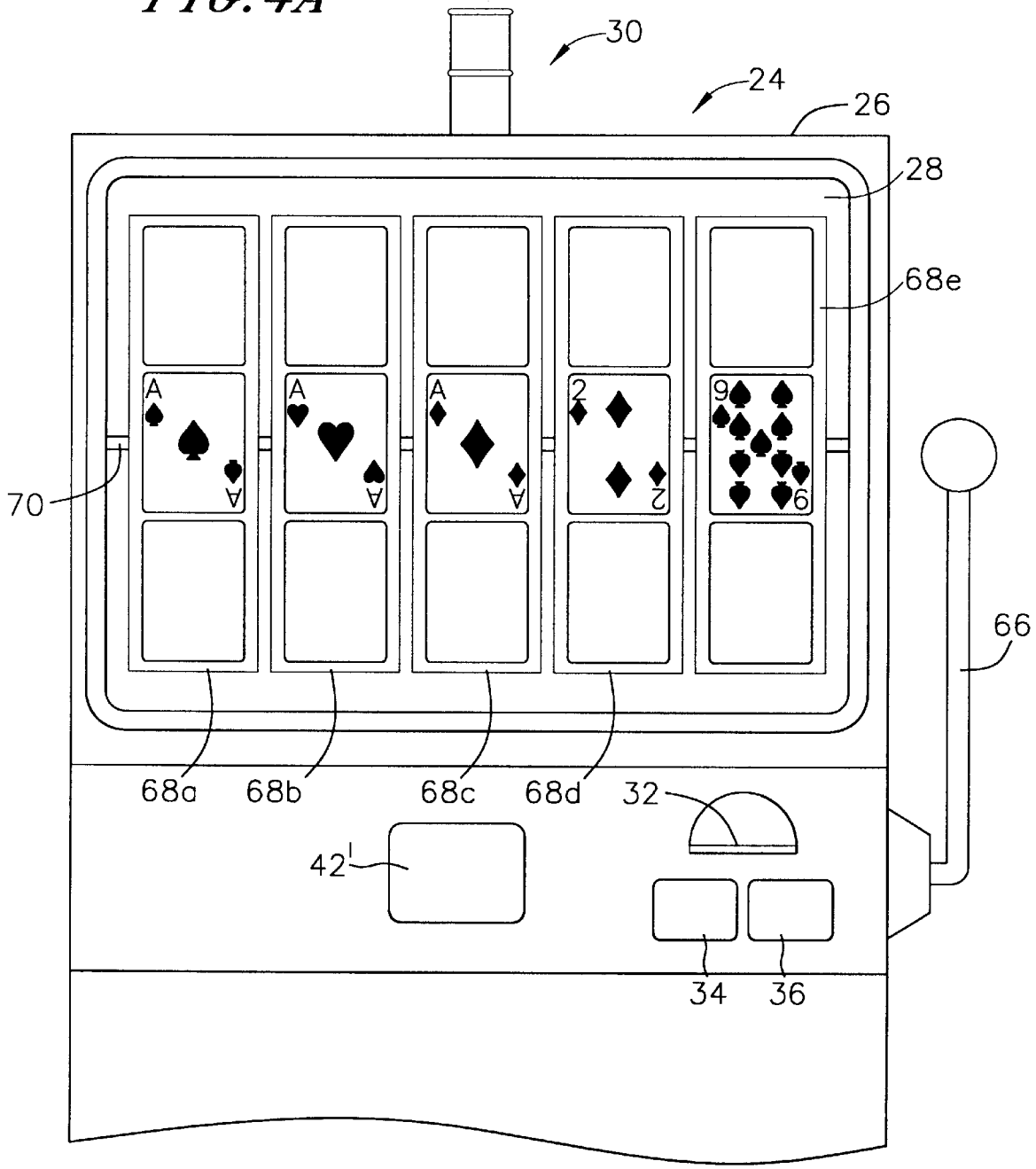
FIGS. 4A–4B show yet another embodiment of a device for playing the game according to the method of the present invention.
Figure 4B:
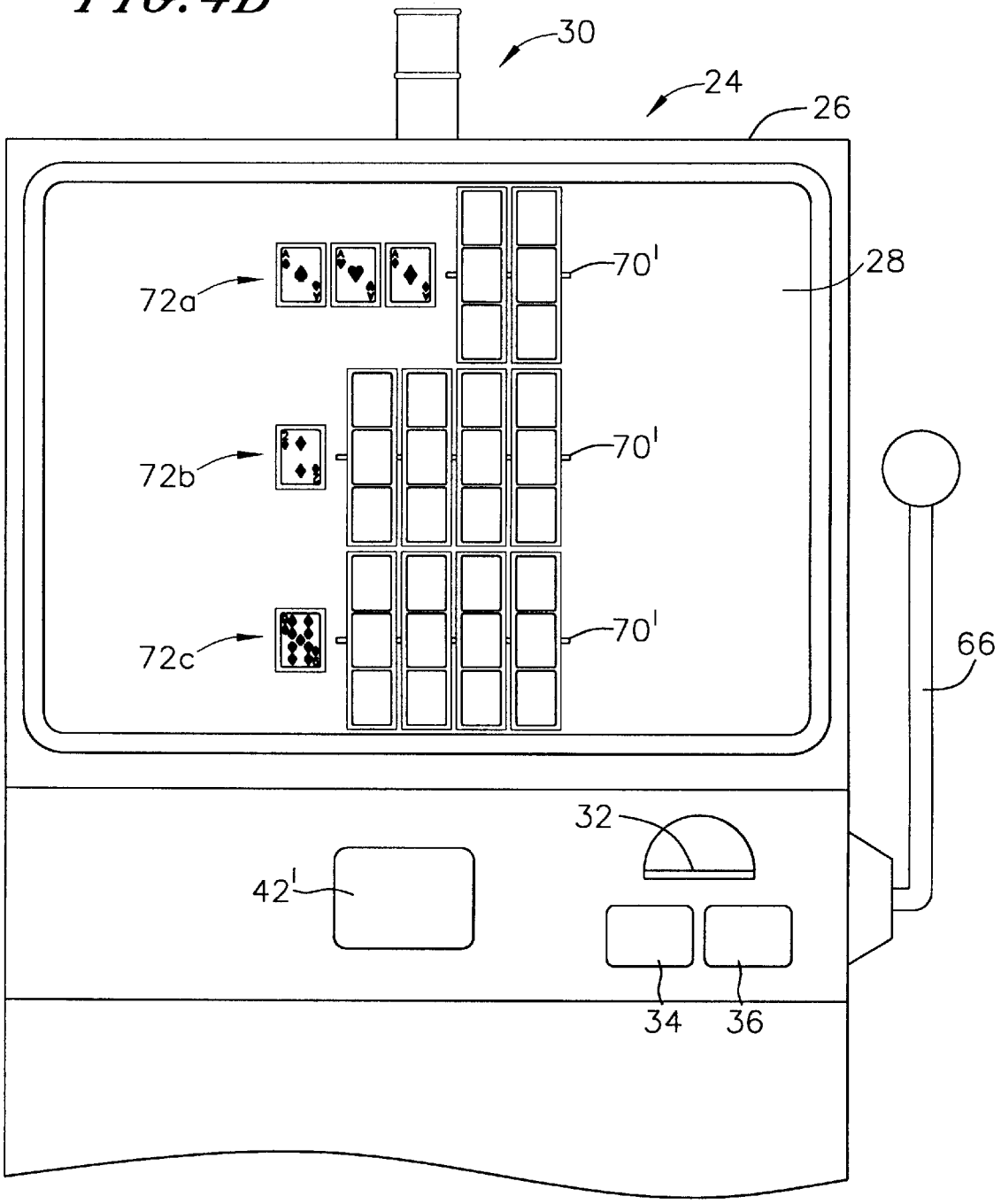

With reference to FIGS. 4A and 4B, yet another embodiment of the present invention is shown. Like components have like reference numerals.

The device 24 according to this embodiment includes a housing 26, display 28, candle 30, coin slot 32, a cash out button 34, a minimum wager button 36 and a max wager/spin button 42'. A handle 66 may also be provided.

The display 28 presents five reels 68*a–e* which are visually presented at the display 28 electronically by the processor (not shown) contained within the device housing 26. Thus, the reels 68*a–e* are not mechanical reels with a plurality of stops as found in conventional electromechanical slot machines, but rather are visual presentations of reels generated at the display 28 by the processor.

To play the game, the player enters a wager. Like the embodiment described above, the selected wager is in an increment of five units and may be, for example, five quarters, five dollars or the like. The maximum wager may be, for example, any selected multiple of five such as ten or fifteen units. To input the minimum wager, e.g. five units, the player depresses the minimum wager button 36. To input a maximum wager, e.g. fifteen units, the player would depress the max wager/spin button 42'. When the desired wager has been entered, the player initiates play of the game. For less than maximum wagers, play may be initiated by the player depressing the max wager/spin button 42' or in the alternative pulling on the handle 66 in a manner well known in the art. Where the player inputs a maximum wager by depressing the max wager/spin button 42' which automatically initiates play.

When play is initiated, the processor, in a well known fashion, selects from a first data structure data representing five cards selected from data representing a deck of 52 cards (or if the game is played in a Joker's wild format, 53 cards). The processor then, at the display 28, simulates the spinning of the reels 68*a–e* to ultimately present the data representing the five cards selected for the initial holding along a pay line 70. The five cards disposed along the pay line 70 represent the initial holding.

In a manner similar to that described above, the player by a touch screen device touches at the display 28 to assemble the selected cards into one or more sub-hands including at least one card each. With reference to FIGS. 4A and 4B, the player has combined the three Aces of the initial holding into one sub-hand of three cards with the remainder of the cards forming two sub-hands of one card each. When so combined, the processor is prompted to drive the display 28 to display the combined sub-hands in the manner illustrated in FIG. 4B. As also illustrated, the display 28 shows additional reel presentations for the selection of additional cards to complete each sub-hand to a final hand of five cards each. Thus with the first sub-hand 72*a* of the three Aces, there is shown two additional reels for selecting the remaining two cards to complete the first sub-hand. The second and third sub-hands 72*b,c*, each display four additional reels to complete those sub-hands to completed hands of five cards each.

With the presentation now displayed as shown in FIG. 4B, the player completes the play by depressing the max wager/spin button 42' whereupon the processor is controlled to select from the first data structure the cards necessary to complete the first, second and third sub-hands 72*a–c* whereupon the reels appear to spin and to ultimately display the selected cards along a pay lines 70'. In this fashion, each of the three sub-hands is completed to final sub-hands of five cards each.

Upon completion of the sub-hands, the processor compares the cards of each sub-hand to data in the second data structure as represented by a pay table 46 (FIG. 2A) to determine if any of the sub-hands compare to a winning combination. Like the embodiment described above, winning combinations are paid and losing combinations result in the loss of wagers.

Also as described above, when the sub-hands are assembled according to this embodiment, the wager is allocated on a pro-rata basis based upon the cards of each sub-hand. With reference to FIG. 4B, the first sub-hand 72*a* would have, for a wager of five units, three units allocated to that sub-hand and the second and third sub-hands 72*b* and 72*c* would have one unit allocated thereto. Payoffs for winning combinations are based upon the amounts allocated.

It is to be understood that while the above description is directed to methods and devices involving playing cards or depictions of playing cards, that other indicia could be used. For example, a field of indicia such as 7's, cherries, bar, fruit or other symbols commonly used in slot machines could be used as the data stored in the first and second data structures. Upon initiation the processor would select a number of indicia and display the same as the first hand. It may be five or any other suitable number. The player would then group the indicia into sub-hands in the manner described above attempting to obtain one or more predetermined winning outcomes, e.g. three 7's. The player's wager is allocated based upon the number of symbols of each sub-hand. Thereafter the play would be completed by the processor completing each sub-hand to, for example, five indicia, four indica or any predetermined completed number of indicia. The completed sub-hands are then compared to a schedule of winning outcomes to determine which, if any, of the completed sub-hands is a winning combination in the manner described above. Further, as described above, completed sub-hand combinations could be designated for jackpots such as two hands of three 7's.

While I have shown and described certain embodiments of the present invention, it is to be understood that the invention is subject to many modifications without departing from the spirit and scope of the claims.

We claim:

1. A method for a player to play a game with playing cards comprising:

the player making a wager;

dealing a first hand of five cards to the player;

grouping the first hand cards into two or more sub-hands each sub-hand forming a partial hand of at least one card each;

allocating a portion of the wager to each sub-hand based upon the number of cards in the sub-hand;

dealing additional cards to each sub-hand to form for each sub-hand a completed hand of five cards;

designating payoffs for completed sub-hand card combinations; and paying each completed hand obtaining a payoff combination based amount of the wager allocated thereto.

2. The method of claim 1 including providing an electronic device having a processor with stored data representing each card of a deck of cards and a display wherein the dealing of said first hand includes said processor randomly selecting from said data said five cards of the first hand and at the display presenting a visual display of said selected cards.

3. The method of claim 2 wherein said grouping of the first hand cards includes said player selecting the grouping of cards in said sub-hands, said display displaying said selected groupings of cards in said sub-hands.

4. The method of claim 3 including, in response to a prompt by the player, said processor randomly selecting from the data representing the remainder of the cards in the deck, cards to complete said sub-hands, and displaying the completed hands.

5. The method of claim 2 including said processor grouping said first hand cards into said sub-hands and randomly selecting from the remainder of said deck of cards to complete said sub-hands.

6. The method of claim 5 including displaying the selection of cards as rotating reels having a plurality of playing cards displayed about the periphery thereof.

7. The method of claim 1 further including allocating a portion of the player's wager to a progressive jackpot, designating an outcome as a jackpot outcome and awarding said progressive jackpot when the player obtains said jackpot outcome.

8. The method of claim 7 including the player making an additional wager to participate in the progressive jackpot, said additional wager allocated to the progressive jackpot.

9. The method of claim 7 including designating two complete hand royal flushes as the jackpot outcome.

10. The method of claim 7 including designating two complete hands of a four of a kind and a royal flush as the jackpot outcome.

11. A method for a player to play a game with playing cards comprising:

the player making a wager;

dealing a first hand of five cards to the player;

the player opting to group the first hand cards into two or more sub-hands, each sub-hand forming a partial hand of at least one card each;

allocating a portion of the wager to each sub-hand based upon the number of cards in the sub-hand;

dealing additional cards to each sub-hand to form for each sub-hand a completed hand of five cards;

designating payoffs for completed sub-hand card combinations; and paying each completed hand obtaining a payoff combination based amount of the wager allocated thereto.

12. The method of claim 11 wherein the player makes a wager in increments of five wagering units.

13. The method of claim 11 including paying the payoffs for each completed hand combinations according to Table 1, Table 1

| | |
|---|---|
| Royal Flush | 800/1 |
| Straight Flush | 50/1 |
| Four-of-a-Kind | 25/1 |
| Full House | 8/1 |
| Flush | 6/1 |
| Straight | 4/1 |
| Three-of-a-Kind | 3/1 |
| Two Pair | 2/1 |
| Pair of Sixes or Better | 1/1 |

* * * * *